US010156348B2

(12) United States Patent
Boorom et al.

(10) Patent No.: US 10,156,348 B2
(45) Date of Patent: Dec. 18, 2018

(54) ARTICULATING LIGHTING ASSEMBLY

(71) Applicant: QUALITE SPORTS LIGHTING, LLC, Hillsdale, MI (US)

(72) Inventors: M. Eric Boorom, Jackson, MI (US); Michael J. Boorom, Jackson, MI (US); Nicholas D. Page, Hillsdale, MI (US); Bret L. Buxton, Spring Lake, MI (US); Gregory Alan Miedema, Spring Lake, MI (US)

(73) Assignee: QUALITE SPORTS LIGHTING, LLC, Hillsdale, MI (US)

( * ) Notice: Subject to any disclaimer, the term of this patent is extended or adjusted under 35 U.S.C. 154(b) by 0 days.

(21) Appl. No.: 15/097,941

(22) Filed: Apr. 13, 2016

(65) Prior Publication Data

US 2017/0299161 A1 Oct. 19, 2017

(51) Int. Cl.

| | |
|---|---|
| ***F21V 31/00*** | (2006.01) |
| ***F21V 21/26*** | (2006.01) |
| ***F21V 29/508*** | (2015.01) |
| ***F21V 29/70*** | (2015.01) |
| ***F21V 21/28*** | (2006.01) |
| *F21Y 101/02* | (2006.01) |

(52) U.S. Cl.

CPC ..... *F21V 21/26* (2013.01); *F21V 21/28* (2013.01); *F21V 29/508* (2015.01); *F21V 29/70* (2015.01); *F21V 31/00* (2013.01); *F21Y 2101/02* (2013.01)

(58) Field of Classification Search

USPC ..... 362/218

See application file for complete search history.

(56) References Cited

U.S. PATENT DOCUMENTS

| | | | |
|---|---|---|---|
| D123,048 | S | 10/1940 | Doane |
| D125,120 | S | 10/1940 | Shulman |
| D127,374 | S | 5/1941 | Jordan |
| D127,391 | S | 5/1941 | Claspy |
| 2,259,151 | A | 10/1941 | Claspy |
| D165,390 | S | 12/1951 | Perry |
| D193,179 | S | 7/1962 | Rutman et al. |
| 3,108,751 | A | 10/1963 | Rodmaker et al. |
| D360,909 | S | 8/1995 | Frederiksen |
| D370,166 | S | 5/1996 | Decursu et al. |
| D381,760 | S | 7/1997 | Costa |
| D421,505 | S | 3/2000 | Hastings et al. |
| D489,472 | S | 5/2004 | Newhouse et al. |
| D505,744 | S | 5/2005 | Kan |
| D525,386 | S | 7/2006 | McCarthy, III |

(Continued)

*Primary Examiner* — Rafferty Kelly

(74) *Attorney, Agent, or Firm* — Price Heneveld LLP

(57) ABSTRACT

A lighting assembly comprises a linearly extending luminaire having an electronic circuit board, an inner lens assembly attached to the forward facing surface of the electronic circuit board, the inner lens including an array of focused light sources, an outer lens disposed over the inner lens assembly, and a heatsink extending along the length of the linearly extending luminaire. A bracket is pivotally attached to the linearly extending luminaire, the bracket having an axis of rotation around a horizontal axis, whereby the linearly extending luminaire is separately rotatable along a horizontal axis relative to the elevated structure. The bracket also has an axis of rotation around a vertical axis, whereby the linearly extending luminaire is separately rotatable along a vertical axis relative to the elevated structure.

17 Claims, 14 Drawing Sheets

(56) References Cited

U.S. PATENT DOCUMENTS

| | | | | |
|---|---|---|---|---|
| D526,082 | S | 8/2006 | McCarthy, III | |
| D543,305 | S | 5/2007 | Wang | |
| D543,657 | S | 5/2007 | Lehman | |
| D572,109 | S | 7/2008 | Busalt et al. | |
| D573,286 | S | 7/2008 | Zettl | |
| D581,080 | S | 11/2008 | Mier-Langner | |
| D589,638 | S | 3/2009 | Collins | |
| D603,079 | S | 10/2009 | Toot et al. | |
| D607,599 | S | 1/2010 | Zhou et al. | |
| D617,488 | S | 6/2010 | Cho | |
| D693,048 | S | 11/2013 | Ng et al. | |
| D695,943 | S | 12/2013 | Duquette et al. | |
| D697,247 | S | 1/2014 | Mollaghaffari | |
| D724,249 | S | 3/2015 | Maxik et al. | |
| D735,385 | S | 7/2015 | Lee et al. | |
| D736,779 | S | 8/2015 | Moon et al. | |
| D737,493 | S | 8/2015 | Yasuji Fletcher et al. | |
| D741,683 | S | 10/2015 | Park et al. | |
| D754,902 | S | 4/2016 | Parker et al. | |
| 9,322,533 | B1 | 4/2016 | Pearson et al. | |
| D774,377 | S | 12/2016 | Hilliaho | |
| D776,335 | S | 1/2017 | Fizer et al. | |
| D781,480 | S | 3/2017 | Zhan | |
| D783,874 | S | 4/2017 | Moller | |
| D785,219 | S | 4/2017 | Swai | |
| D785,220 | S | 4/2017 | Swai | |
| 2005/0117333 | A1* | 6/2005 | Yoshida | F21S 8/033 362/147 |
| 2010/0254148 | A1 | 10/2010 | Huang et al. | |
| 2010/0315812 | A1* | 12/2010 | Liu | F21S 8/02 362/235 |
| 2011/0002124 | A1 | 1/2011 | Chang et al. | |
| 2011/0051407 | A1 | 3/2011 | St. Ives et al. | |
| 2011/0141722 | A1 | 6/2011 | Acampora et al. | |
| 2013/0271977 | A1 | 10/2013 | Ronen et al. | |

* cited by examiner

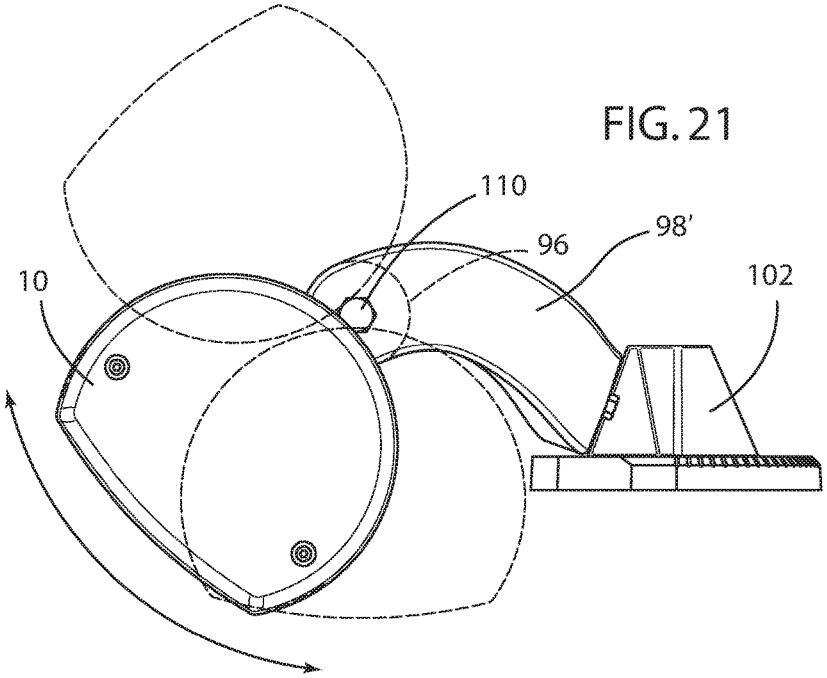
FIG. 21
FIG. 22
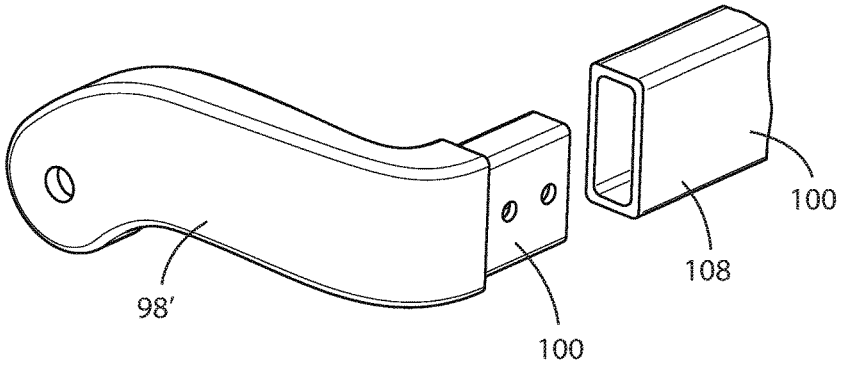

ARTICULATING LIGHTING ASSEMBLY

FIELD OF THE INVENTION

The present disclosure generally relates to an improved lighting assembly, and more particularly, to a lighting assembly that includes an elongated and linearly extending luminaire and an articulating mounting bracket affixed to an elevated support structure.

BACKGROUND OF THE INVENTION

Modern lighting systems for outdoor applications, such as parking lots and sports stadiums, have been developed. Such systems typically involve the use of square, rectangular, and/or round shaped lighting fixtures requiring relatively elaborate brackets for mounting to an elevated height, such as a pole or an elevated scaffold. Such mounting brackets tend to be expensive, heavy, and relatively difficult to assemble. Moreover, such lighting systems are difficult to aim and thus it is sometimes difficult to situate the lighting fixture to provide the desired lighting coverage over the relevant field below. An improvement over prior lighting systems was desired.

SUMMARY OF THE INVENTION

According to one aspect of the present disclosure, a lighting assembly includes a linearly extending luminaire comprising an electronic circuit board having a first forward facing surface and a second rearward facing surface. An inner lens assembly is attached to the forward facing surface of the electronic circuit board, and includes an array of focused light sources. An outer lens is disposed over the inner lens assembly and a heatsink attached to the second rearward facing surface of the electronic circuit board, the heatsink having a rear surface and extending along the length of the linearly extending luminaire. A bracket is pivotally attached to the linearly extending luminaire, and has an axis of rotation around a horizontal axis, whereby the linearly extending luminaire is separately rotatable along a horizontal axis relative to the elevated structure. The bracket also has an axis of rotation around a vertical axis, whereby the linearly extending luminaire is separately rotatable along a vertical axis relative to the elevated structure.

According to another aspect of the present disclosure, a lighting assembly for providing an enlarged area of illumination over an area of land includes an elevated structure and a plurality of linearly extending luminaires attached thereto. Each of the linearly extending luminaires has an electronic circuit board having a first forward facing surface and a second rearward facing surface, an inner lens assembly attached to the forward facing surface of the electronic circuit board, the inner lens assembly including an array of focused light sources, an outer lens disposed over the inner lens assembly, and a heatsink attached to the second rearward facing surface of the electronic circuit board, the heatsink having a rear surface and extending along the length of the litter in the linearly extending luminaire. A plurality of brackets is pivotally attached to each of the linearly extending luminaires, each of the brackets having an axis of rotation around a horizontal axis, whereby each of the plurality of linearly extending luminaires is separately rotatable along a horizontal axis relative to the elevated structure. Each of the brackets also has an axis of rotation around a vertical axis, whereby each of the plurality of linearly extending luminaires is separately rotatable along a vertical axis relative to the elevated structure.

According to yet another aspect of the present disclosure, a lighting assembly includes an elevated structure and an elongated luminaire having an electronic circuit board having a first forward facing surface and a second rearward facing surface, an inner lens assembly attached to the forward facing surface of the electronic circuit board, the inner lens assembly including an array of focused light sources, an outer lens disposed over the inner lens assembly, and a heatsink attached to the second rearward facing surface of the electronic circuit board and extending along the length of the elongated luminaire. A bracket is pivotally attached to the linearly extending luminaire, the bracket having an axis of rotation around a horizontal axis, whereby the elongated luminaire is separately rotatable along a horizontal axis relative to the elevated structure. The bracket also has an axis of rotation around a vertical axis, whereby the elongated luminaire is separately rotatable along a vertical axis relative to the elevated structure.

These and other aspects, objects, and features of the present disclosure will be understood and appreciated by those skilled in the art upon studying the following specification, claims, and appended drawings.

BRIEF DESCRIPTION OF THE DRAWINGS

In the drawings:

FIG. 21 is a right side view of the lighting assembly of FIG. 20; and

FIG. 22 is a rear perspective view of the mounting bar arms of the lighting assembly of FIG. 20.

DETAILED DESCRIPTION OF THE EMBODIMENTS

Figure 1:
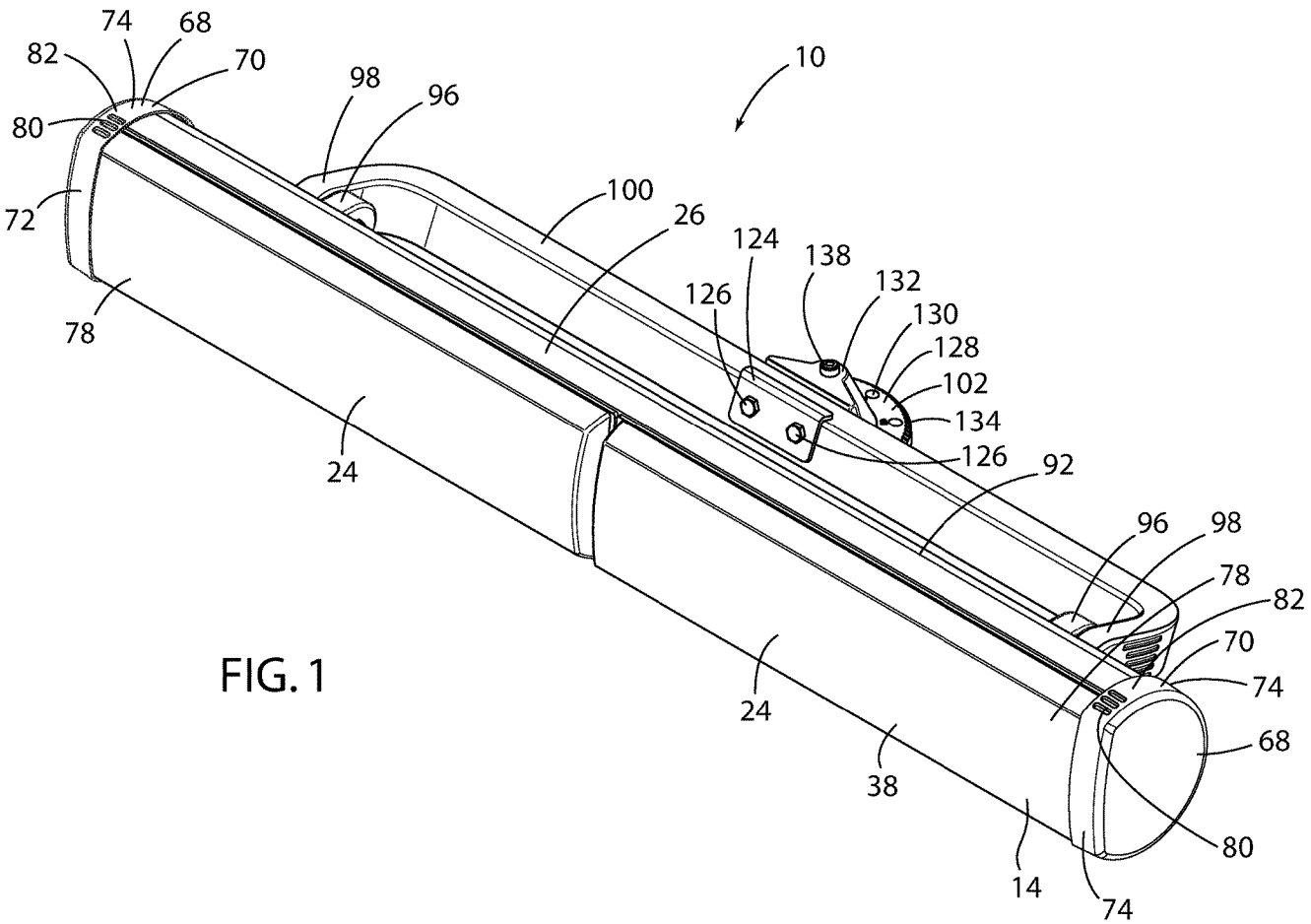
FIG. 1 is a top perspective view of a first embodiment of the lighting assembly of the present disclosure.

As referenced in the figures, the same reference numerals may be used herein to refer to the same parameters and components or their similar modifications and alternatives. For purposes of description herein, the terms "upper," "lower," "right," "left," "rear," "front," "vertical," "horizontal," and derivatives thereof shall relate to the present disclosure as oriented in FIG. 1. However, it is to be understood that the present disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. The drawings referenced herein are schematic and associated views thereof are not necessarily drawn to scale.

Figures 2, 3, 4, 5:
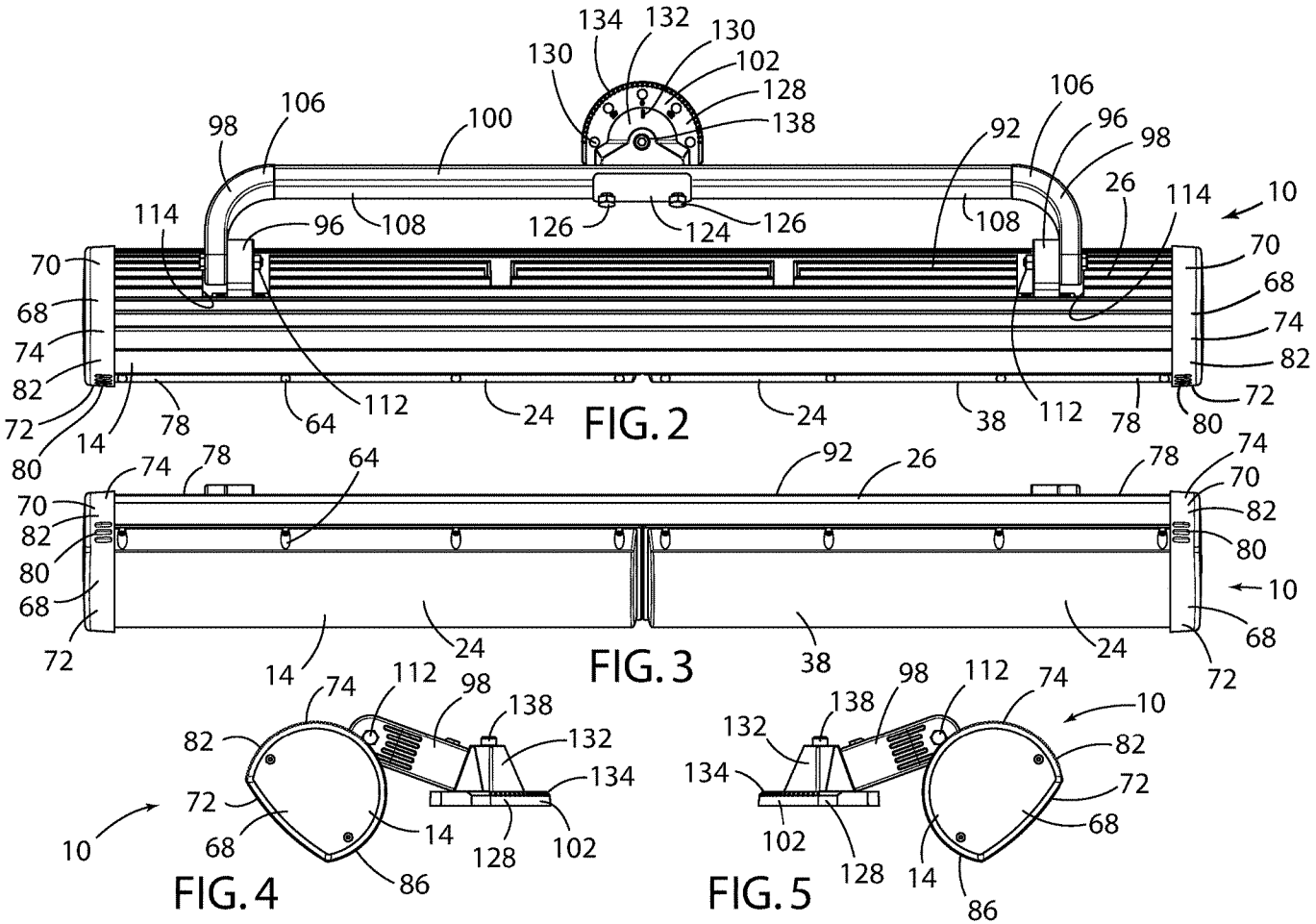
FIG. 2 is a top view of the lighting assembly of FIG. 1.
FIG. 3 is an oblique front and top view of the lighting assembly of FIG. 1.
FIG. 4 is a right side view of the lighting assembly of FIG. 1.
FIG. 5 is a left side view of the lighting assembly of FIG. 1.
Figure 6:
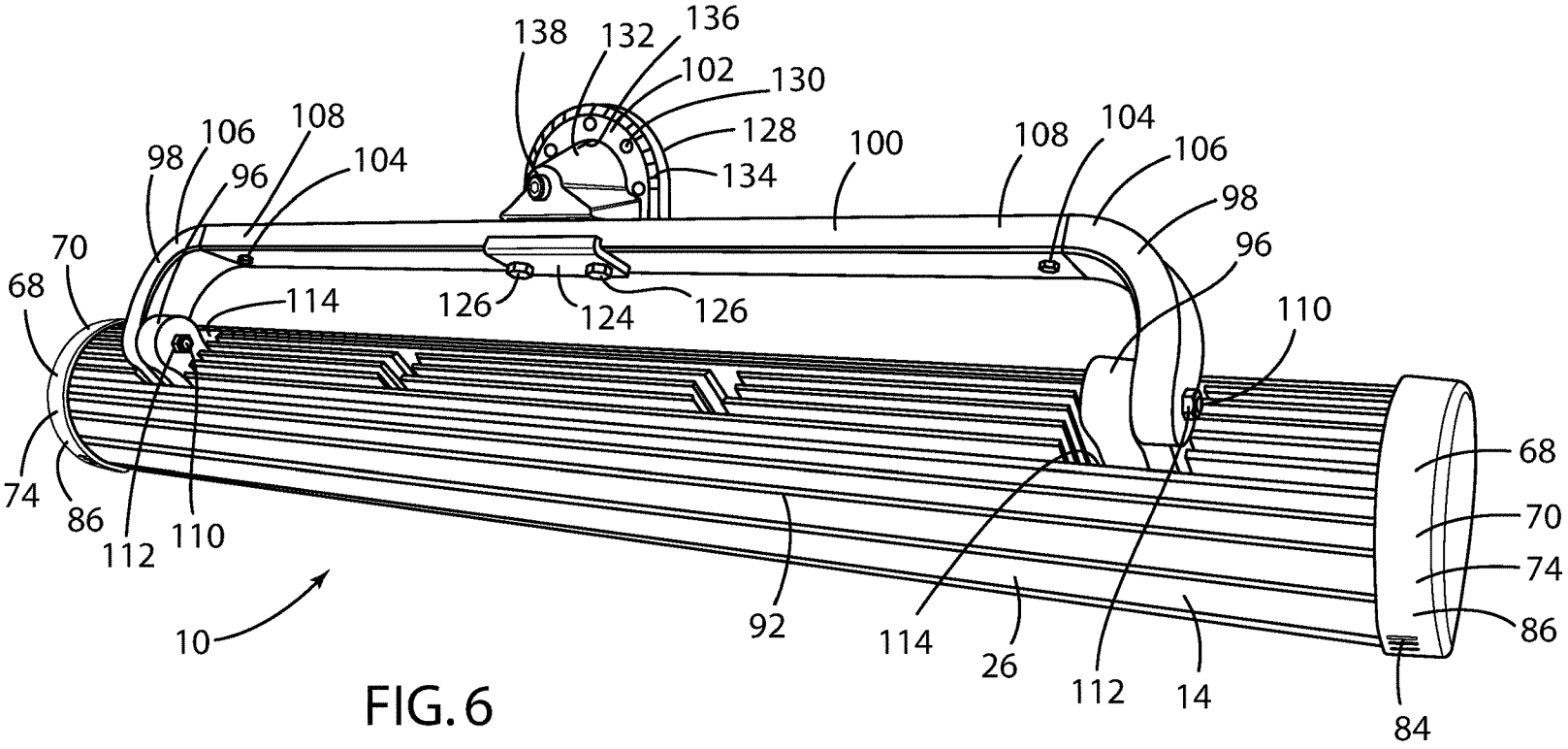
FIG. 6 is a rear perspective view of the lighting assembly FIG. 1.

Referring to FIGS. 1 and 2, reference numeral 10 generally designates a lighting assembly for mounting on an elevated structure 12, such as an elevated pole or scaffolding system. The lighting assembly 10 of the present disclosure is particularly well-suited for use in providing illumination for outdoor facilities such as sports fields and stadiums, and that require illumination for the players and observers. Typically, such sports fields tend to be of a rectangular nature and in the past lighting assemblies have been or have comprised circular light sources. By virtue of the elongated and rectangular nature of the lighting assembly 10 of the present disclosure, the rectangular playing field can be completely illuminated without the presence of shadows or darker areas and the shortcoming of prior lighting assemblies is overcome. In addition, neighboring areas where illumination were would be undesirable can be avoided.

In practice, a plurality of elevated structures 12 is preferably disposed about the perimeter of a viewing area, such as the sports field or the stadium. The number of elevated structures 12, and the lighting assemblies 10 mounted thereon, is dependent upon the size of the playing field and adjacent areas that are to be illuminated. Each of the elevated structures 12 is provided with a plurality of lighting assemblies 10 in accordance with the present disclosure.

Each of the lighting assemblies 10 comprises a plurality of linearly extending luminaires 14 in accordance with the present disclosure. Each of the linearly extending luminaries comprises an electronic circuit board 16 having a first forward facing surface 18 and a second rearward facing surface 20, an inner lens assembly 22 attached to the forward facing surface 18 of the electronic circuit board 16, an outer lens 24 disposed over the inner lens assembly 22, and a heatsink 26 attached to the second rearward facing surface 20 of the electronic circuit board 16. A bracket 28 is pivotally attached to the linear extending luminaries 14 to mount them to the elevated structures, as further described below.

Figure 12:
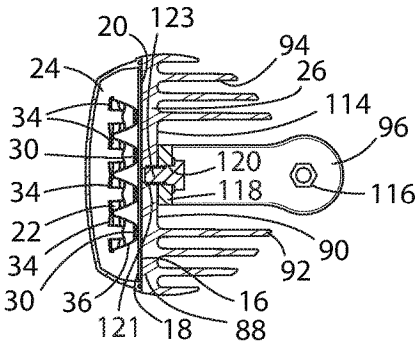
FIG. 12 is a cross-sectional view of the linearly extending luminaire of FIG. 9 along the line XII-XII.
Figure 11:
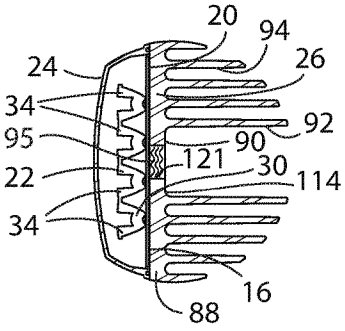
FIG. 11 is a cross-sectional view of the linearly extending luminaire FIG. 9 along the line XI-XI.
Figure 10:
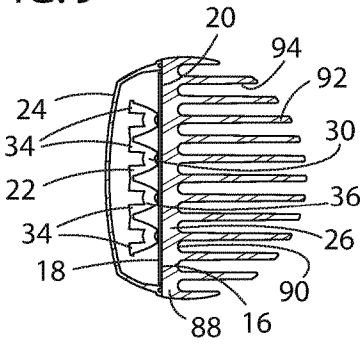
FIG. 10 is a cross-sectional view of the linearly extending luminaire of FIG. 9 along the line X-X.
Figure 13:
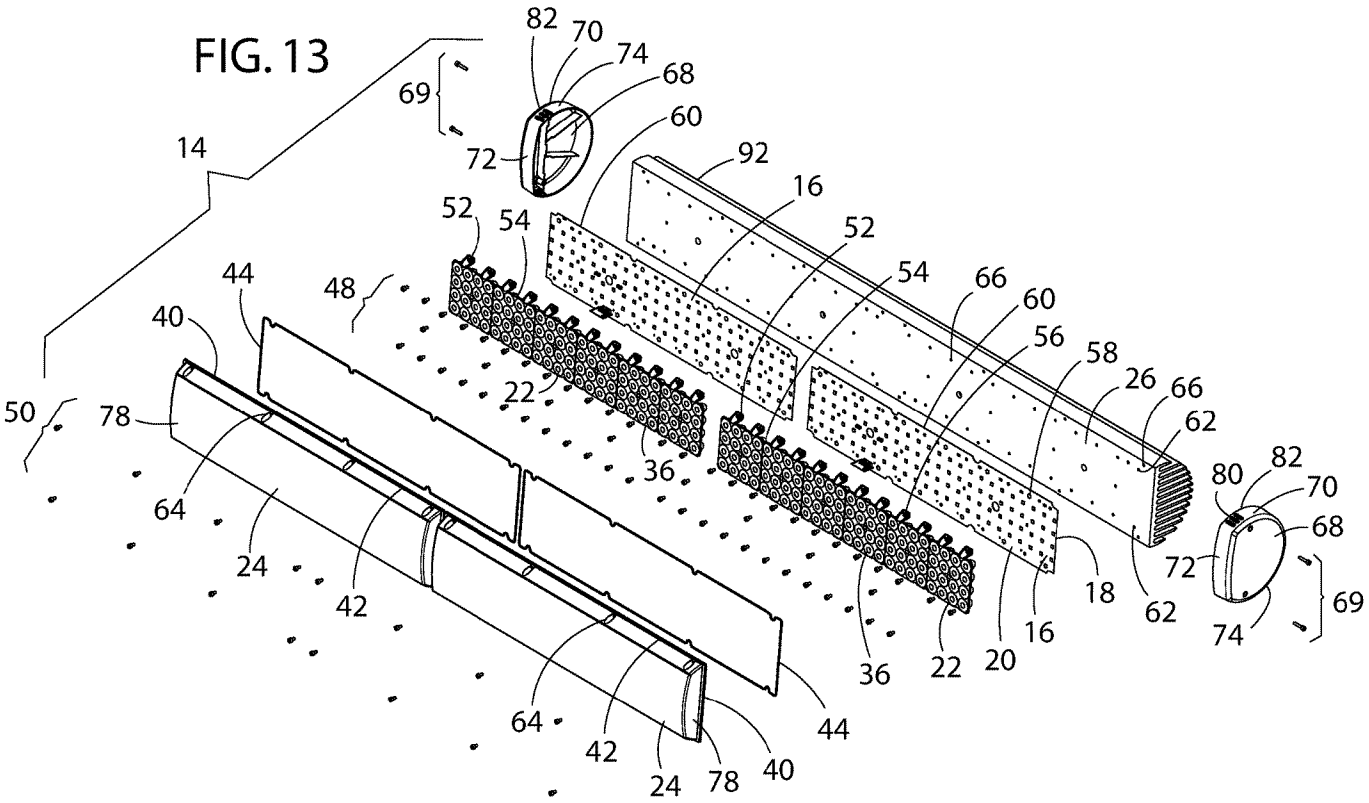
FIG. 13 is an exploded top perspective view of the linearly extending luminaire of the lighting assembly of FIG. 1.

The electronic circuit board 16 may be constructed from conventional materials and is provided with a series of electrical connectors 30 on the first forward facing surface 18 of the electronic circuit board 16 for electrically coupling a plurality of individual LED lamps 32 attached to the first forward facing surface 18 of the electronic circuit board 16, as shown in FIGS. 10-12. The second rearward facing surface 20 of the electronic circuit board 16 is provided with the circuitry appropriate to provide electrical power to the individual LED lamps 32 so arranged and mounted to the electronic circuit board 16. The circuitry can include the power supply, transformers, and other circuit components necessary and appropriate for supplying power to the individual LED lamps 32.

Each of the individual LED lamps 32 is further disposed within a matching plurality of recesses 34 situated as an array upon the inner lens assembly 22. Each of the plurality of recesses 34 forms a focused lens for each of the individual LED lamps 32 received therein. The inner lens assembly 22, being formed of a clear polycarbonate material through which the light emitted from the individual LED lamps 32 can be projected, thereby provides a focused lens housing 36 disposed across substantially an entire forward face 38 of the linearly extending luminaire 14 to create an array of individually focused light sources disposed substantially completely over the forward face of the linearly extending luminaire 14. The inner lens assembly 22 is preferably formed as a rectangular shape to substantially conform to the rectangular shape of the electronic circuit board 16. This creates a simpler packaging solution and allows the electronic circuit board 16 and the inner lens assembly 22 containing the individual LED lamps 32 to be sealingly enclosed within the linear linearly extending luminaire 14.

Figure 14:
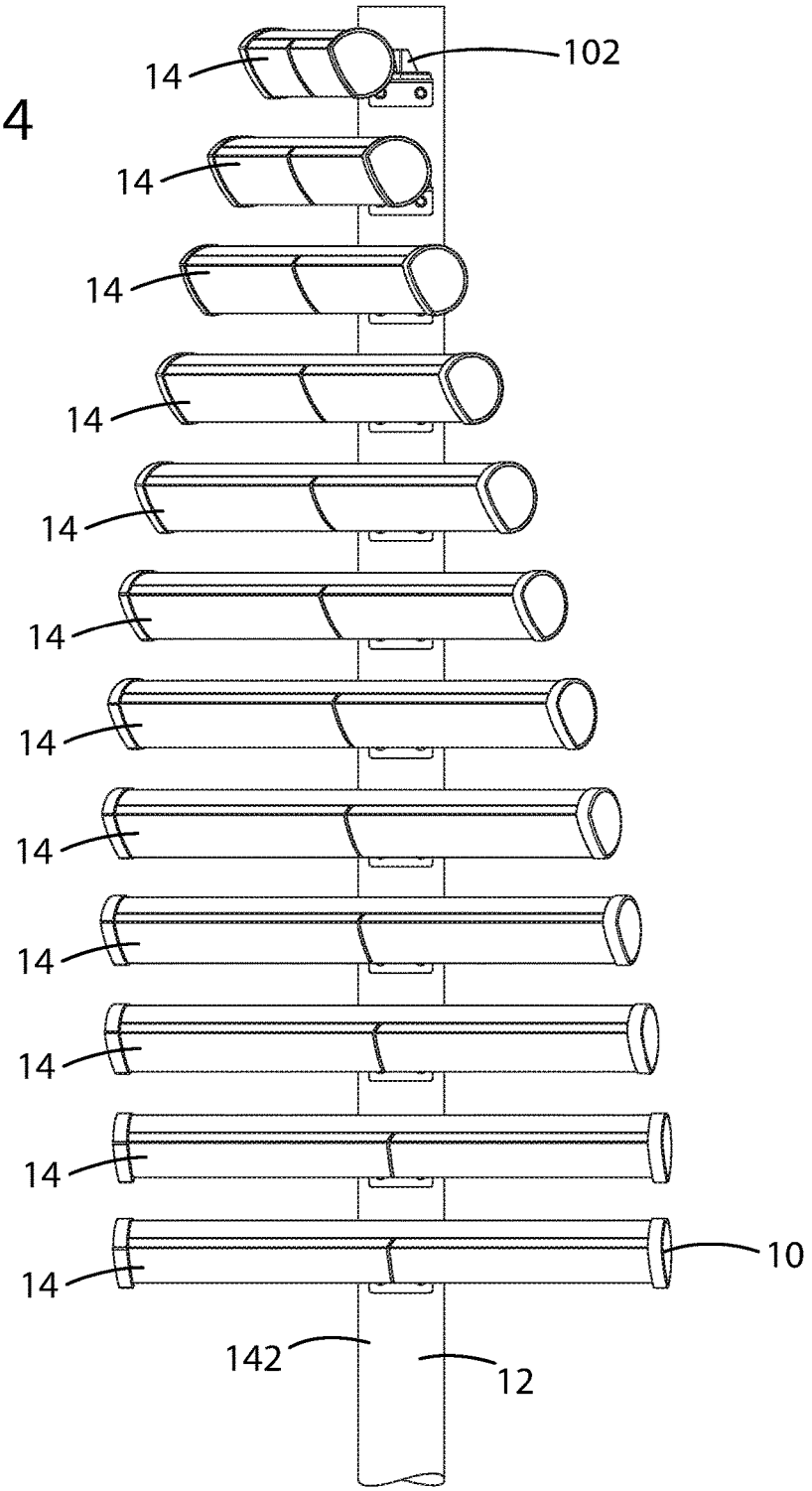
FIG. 14 is a front view of an elevated support supporting a plurality of the lighting assemblies of FIG. 1.

To effectuate such enclosure, is best shown in FIG. 14, the outer lens 24 is disposed over the inner lens assembly 22. The outer lens 24 is preferably provided with a flange 40 that extends about the outer perimeter 42 of the outer lens 24, which is formed in the same substance rectangular shape as that of the inner lens assembly 22 and electronic circuit board 16. A seal or O-ring 44 preferably extends about the outer perimeter 42 of the outer lens 24 and is received within the flange 40 of the outer lens 24. When the outer lens 24 is installed over the inner lens assembly 22 and electronic circuit board 16, as discussed below, the O-ring 44 is brought into ceiling engagement with the heatsink 26 to sealingly enclose the inner lens assembly 22 and electronic circuit board 16. Preferably, the portion of the outer lens 24 proximate the heatsink 26 is frosted to reduce glare from the side of the luminaire 14, while the forward face 38 of the luminaire 14 is clear to better transmit light there through.

As shown in FIG. 5, the linearly extending luminaire 14 preferably comprises a pair of electronic circuit boards 16 and a pair of inner lens assemblies 22 attached to the heatsink 26 in a side-by-side arrangement. Preferably, a corresponding pair of O-rings 44 sealingly engages each of the pair of electronic circuit boards 16 and inner lens assemblies 22 to a forward facing 46 of the heatsink 26. The outer lens 24 can be fabricated from a single injection molded poly-carbonate component extending across the length of the linearly extending luminaire 14 and adapted to engage the entire perimeter of each of the pair of O-rings 44, with a flange (not shown) extending vertically in the middle. Alternatively, the outer lens 24 can be fabricated as a pair of separate outer lens components, as shown in the figures, each adapted to engage one of the pair of O-rings 44 and thereby seal one of the pair of electronic circuit boards 16 and inner lens assemblies 22 to the forward face 46 of the heatsink 26.

The linearly extending luminaire 14 may be readily assembled through a plurality of threaded fasteners 48, 50. The first set of threaded fasteners 48 is used to threadingly attach the inner lens assembly 22 to the forward face 46 of the heatsink 26 through a plurality of mounting legs 52 arranged about the perimeter 54 of the inner lens assembly 22, each which is provided with an opening 56 to receive one of the first set of threaded fasteners 48. The electronic circuit board 16 is similarly preferably provided with a series of openings 58 arranged about the perimeter 60 of the electronic circuit board 16 corresponding to the pattern of the openings 56 in the mounting legs 52 of the inner lens assembly 22. The forward face 46 of the heatsink 26 is provided with a plurality of threaded holes 62 that likewise correspond to the pattern of openings 56 in the mounting legs 52 of the inner lens assembly 22 and the openings 58 in the electronic circuit board 16. Thus, the electronic circuit board 16 and the inner lens assembly 22 can be securely fastened to the forward face 46 of the heatsink 26, and the heat-sink 26 can be thereby brought into juxtaposed and physical contact with the rearward facing surface 20 of the electronic circuit board 16 and its associated circuitry.

A second set of threaded fasteners 50 extends through beveled openings 64 arranged about and proximate to the perimeter 42 of the outer lens 24. The forward face 46 of the heatsink 26 is provided with a plurality of threaded holes 66 along the forward face 46 of the heatsink 26 that likewise correspond to the pattern of beveled openings 64 in the outer lens 24. Thus, when the outer lens 24 is assembled to the linearly extending luminaire 14, the O-ring 44 is compressed between the flange 40 arranged around the perimeter 42 of the outer lens 24 and the forward face 46 of the heatsink 26, thus sealingly enclosing the electronic circuit board 16 and the inner lens assembly 22 within the linearly extending luminaire 14.

The linearly extending luminaire 14 further preferably includes a pair of opposed end caps 68 attached via fasteners 69. Each of the end caps 68 engages the outer lens 24 and the heatsink 26 at opposed ends of the linearly extending luminaire 14. The end caps 68 are preferably formed with an flange 70 shaped to conform to the side profile configuration of the assembled linearly extending luminaire 14, having a substantially flat forward portion 72 along the flange 70 and a substantially circular portion 74 around the heatsink 26, as further described below. It is preferred that the inner forward portion 76 of the flange 70 of the endcap 68 proximate the substantially flat forward portion 72 be slightly inclined so as to wedge and thereby force the end portions 78 of the outer lens 24 into contact with the O-ring 44, which is thereby further urged against the forward face 46 of the heatsink 26. The end caps 68 thus further provide additional structural stability to the assembly by essentially clamping the outer lens 24 into contact with the heatsink 26.

The end caps 68 are also preferably provided with a plurality of openings 80 on an upper portion 82 of the flange 70 proximate an upper portion of the linearly extending luminaire 14 and a plurality of openings 84 on a lower portion 86 of the flange 70 proximate a lower portion of the linear extending luminaire 14. The plurality of openings above 80 and the plurality of openings 84 below provide a path by which heat energy may be convected from the end of the linearly extending luminaire 14 as relatively warm rises through the openings 80, 84 to thereby reduce the temperature within the linearly extending luminaire 14. Additionally, the end caps 68 may be used to display trademarks and other indicia associated with the supplier of the lighting assembly 10, as well as display aesthetically pleasing graphical designs. Likewise, the end caps 68 can be molded in desired colors to indicate a particular source of the goods and/or to provide aesthetic appeal.

The heatsink 26 is preferably constructed from an aluminum alloy and extends across the entire length of the linearly extending luminaire 14. The heatsink 26 includes a base 88, forming the forward face 46 of the heatsink 26 and rearward face 90 of the heatsink 26. A plurality of horizontally extending cooling fins 92 extends from the rearward face 90, where each of the cooling fins 92 is separated by an air gap 94, as is known in the art to dissipate heat from an internal source. With the electronic circuit board 16 in juxtaposed and physical contact with the forward face 46 of the heatsink 26 and thereby in physical contact with the circuitry of the electronic circuit board 16, the heat generated by the LED lamps 32 and the circuitry will flow through the aluminum heatsink 26 from the forward face 46 to the rearward face 90 and further through the cooling fins 92 to the atmosphere. Preferably, the rearward face 90 of the heatsink 26 includes a pair of vents 95, as shown in FIG. 11, that are disposed within a pair of recesses 97. The upper openings 80, the lower openings 84, and the vents 95 are particularly helpful in relieving the pressure of the internal air as the air expands within the linearly extending luminaire 14 as a result of heat generated during operation. Thus, the LED lamps 32, which are otherwise enclosed within the linearly extending luminaire 14, can be kept at a relatively cool temperature, which is necessary to prolong their useful life and provide a light source of satisfactory duration. Preferably, the LED lamps 32 so situated in the device of this kind can last for thousands of hours.

Preferably, the linearly extending luminaire 14 can be offered in different sizes. In a first size, as shown in FIG. 1, the linearly extending luminaire 14 is preferably approximately 50 inches long and comprises a pair of electric circuit boards 16, inner lens assemblies 22, outer lens 24, and O-rings 44, as described above. In this size, the linearly extending luminaire 14 is preferably capable of providing 115,000 lumens of light at a power consumption rate of 1000 W, resulting in a power consumption 115 lumens per watt. Power can be provided at 120, 208, 240, 277 and 480 voltage levels by the use of appropriate transformers. Preferably, the linearly extending luminaire 14 is capable of operation between −40° C. and 55° C.

Alternatively, the heatsink 26 is shortened to the length of one of the pair of electric circuit board 16, inner lens assemblies 22, outer lens 24, and O-rings 44, so as to provide a linearly extending luminaire 14 of half the length of the size shown in FIG. 1, or 25 inches in length. In this second size, the linearly extending luminaire 14 is preferably capable of providing 58,000 lumens of light at a power consumption rate of 500 W, similarly resulting in a power consumption 115 lumens per watt.

Mounting of the linearly extending luminaire 14 is obtained through the bracket 28 and a pair of mounting ears 96 attached to the heatsink 26 proximate each end of the linearly extending luminaire 14. The bracket 28 comprises a pair of opposed mounting arms 98, a central member 100 extending between the opposed mounting arms 98, and a mounting base 102 coupled to the central member 100. The central member 100 may be integral with the pair of opposed mounting arms 98, but is preferably attached via a threaded fastener 104 through a telescoping end 106 of the each of the opposed mounting arms 98 received within an end 108 of the central member 100. Each of the pair of opposed mounting arms 98 of the bracket 28 is pivotally attached to one of the pair of mounting ears 96 via a pivot pin 110 extending inwardly at a distal end of each of the opposed mounting arms 96, which themselves curve forwardly from the central member 100 to engage the mounting ears 96. A corresponding opening (not shown) in the mounting ears 96 receives the pivot pin 110. Preferably, the pivot pin 110 is threaded at a distal end thereof and a locking fastener 112, such as a locking not, can be loosened to allow the linearly extending luminaire 14 to pivot within the horizontal axis along the length of the linearly extending luminaire 14 relative the bracket 28. When the linearly extending luminaire 14 is positioned in a desired angle relative to the bracket 28, the locking fastener 112 can be tightened to secure the linearly extending luminaire 14 in that position.

Figure 7:
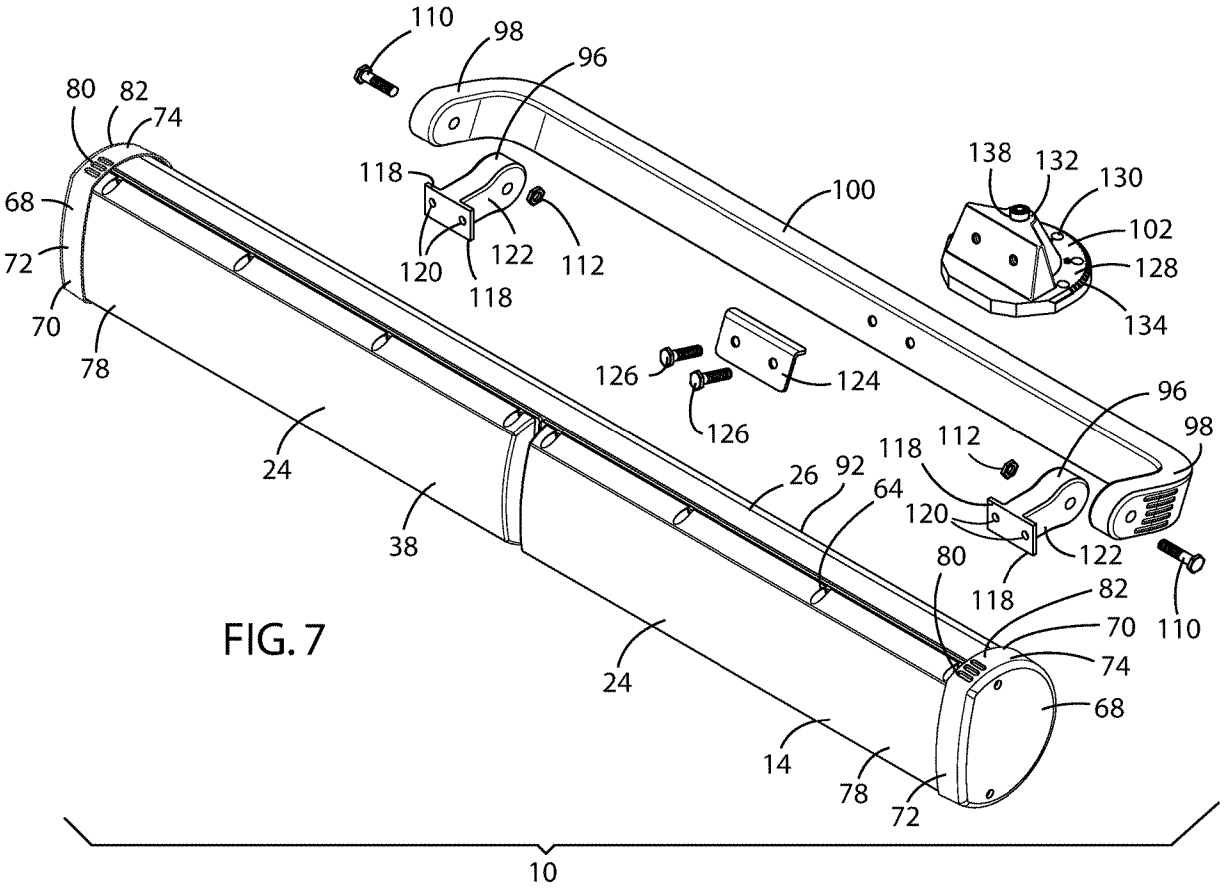
FIG. 7 is an exploded top perspective view of the lighting assembly of FIG. 1.
Figure 8:
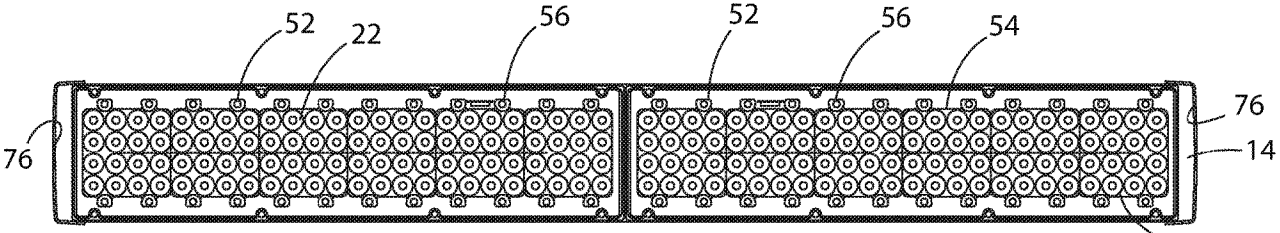
FIG. 8 is a front cross-sectional view of the linearly extending luminaire of the lighting assembly of FIG. 1.
Figure 9:
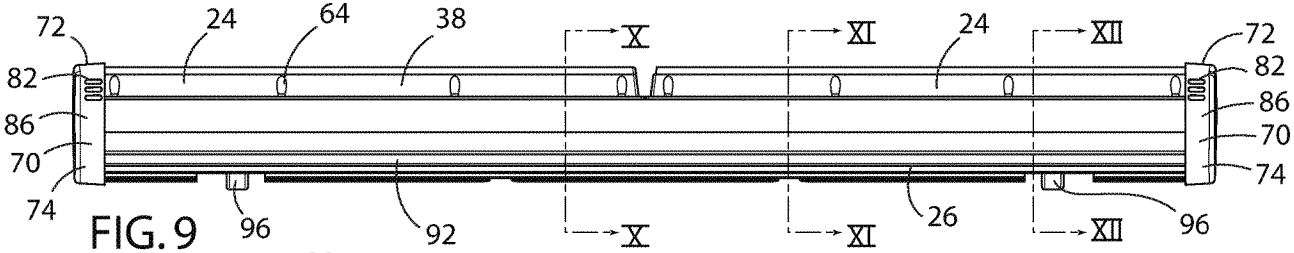
FIG. 9 is a bottom view of the linearly extending luminaire of the lighting assembly of FIG. 1.

The mounting ears 96 may be integrally cast into the aluminum alloy structure of the heatsink 26 and extend rearward beyond the end side profile of the linearly extending luminaire 14 within a recess 114. Alternatively, the mounting ears 96 may be provided with a flange 118 on either side of a base 122 of the mounting ears 96, each of which can be provided with an opening 120 that corresponds with an opening 121 in the rearward face of the heatsink 26, whereby a plurality of fasteners 123 may be used to attach the base 122 of the mounting ears 96 to the rearward face 90 of the heatsink 26, as shown in FIGS. 7 and 12.

Figure 20:
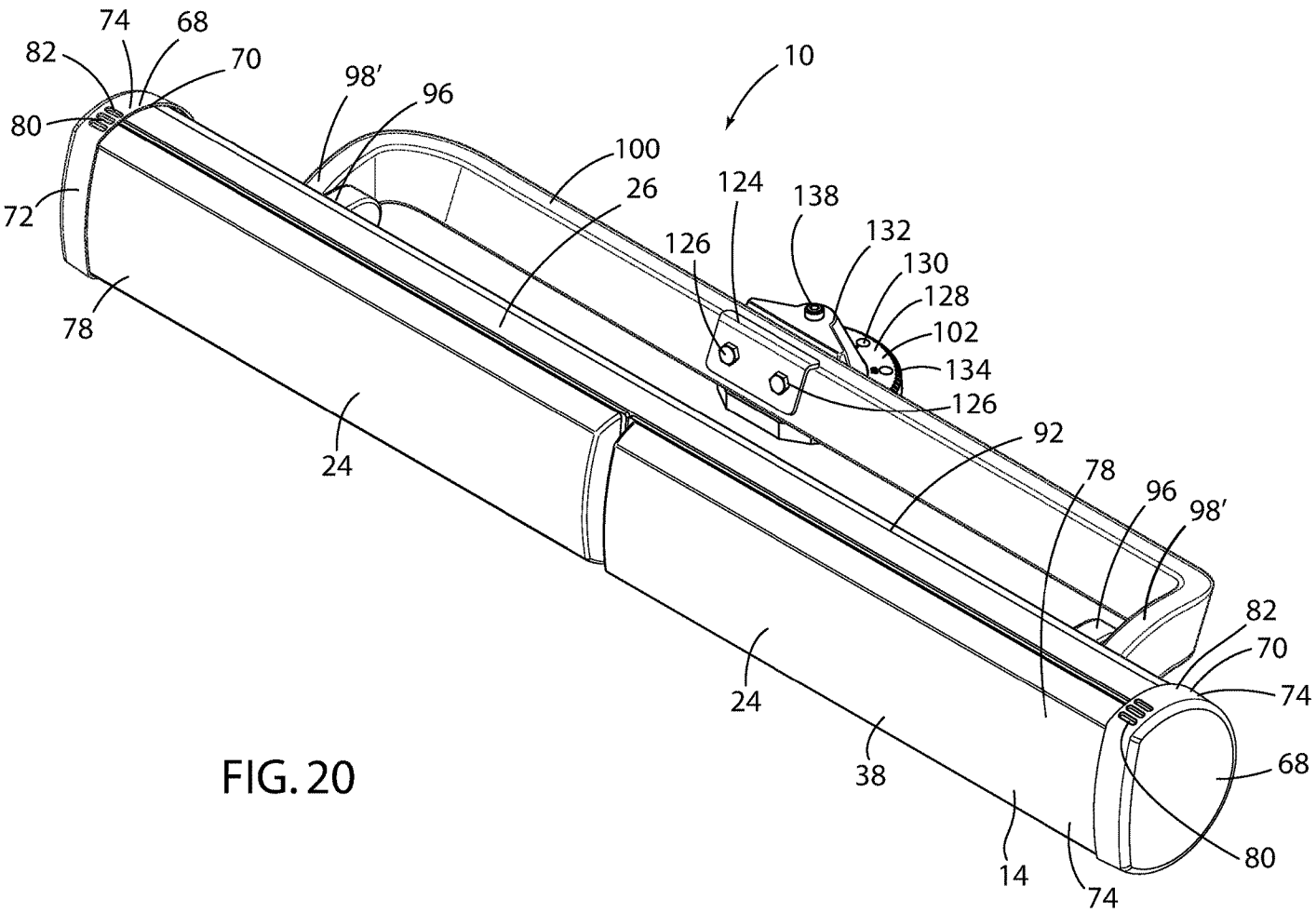
FIG. 20 is a top perspective view of a third embodiment of the lighting assembly of the present disclosure.

An alternative embodiment for the mounting arms 98 is shown in FIGS. 20, 21, and 22. In this embodiment, curved mounting are arms 98' are curved forwardly and downwardly as shown to allow for additional vertical aiming of the linearly extending luminaire 14. Otherwise the curved mounting bar arms 98' are constructed similar to the mounting bar arms 98 that do not curve downwardly, but rather extend straight from the central member 100. Each of the pair of curved opposed mounting bar arms 98' of the bracket 28 is likewise pivotally attached to one of the pair of mounting ears 96 via the pivot pin 110 extending inwardly at a distal end of each of the opposed mounting bar arms 98' to engage the mounting ears 96. Each of the pair of curved opposed mounting bar arms 98' of the bracket 28 is also preferably attached via a threaded fastener 104 through a telescoping end 106' of the each of the opposed mounting bar arms 98' received within an end 108 of the central member 100.

The mounting base 102 includes an attachment clamp 124 rigidly engaged with the central member 100 by fasteners 126 and a mounting member 128 adapted to support the lighting assembly 10. The mounting member 128 is preferably of a circular configuration with a plurality of openings 130 disposed about a portion of its perimeter to which fasteners may be used to attach the mounting member 128 to the elevated structure 12. The central member 100 is rotatably coupled with the mounting member 128 via a mounting pivot 132. Preferably, a plurality of angular indexes 134 is provided around a portion of the circumference of the mounting member 128 and an indicator 136 is mounted on the mounting pivot 132, which is attached to the attachment clamp 124. As the attachment clamp 124 and mounting pivot 132 are rotated about the vertical axis, the indicator 136 will move about the circumference in in alignment with one of the angular indexes 134, which in turn will disclose the relative angle at which the attachment clamp 124 and mounting pivot 132 are orientated relative to the mounting member 128. A fastening device, such as a main bolt 138, can be tightened and thereby secure the mounting pivot 132 to the mounting member 128 and prevent further rotation of the attachment clamp 124 in mounting pivot 132 relative the mounting member 128. With the attachment clamp 124 rotatably coupled with the mounting member 128 of the bracket 28 and the mounting member 128 rotatably coupled with the linearly extending luminaire 14, the linearly extending luminaire 14 is adapted to rotate in multiple axis relative the mounting member 128 of the mounting base 102, and ultimately the elevated structure 12.

Figure 15:
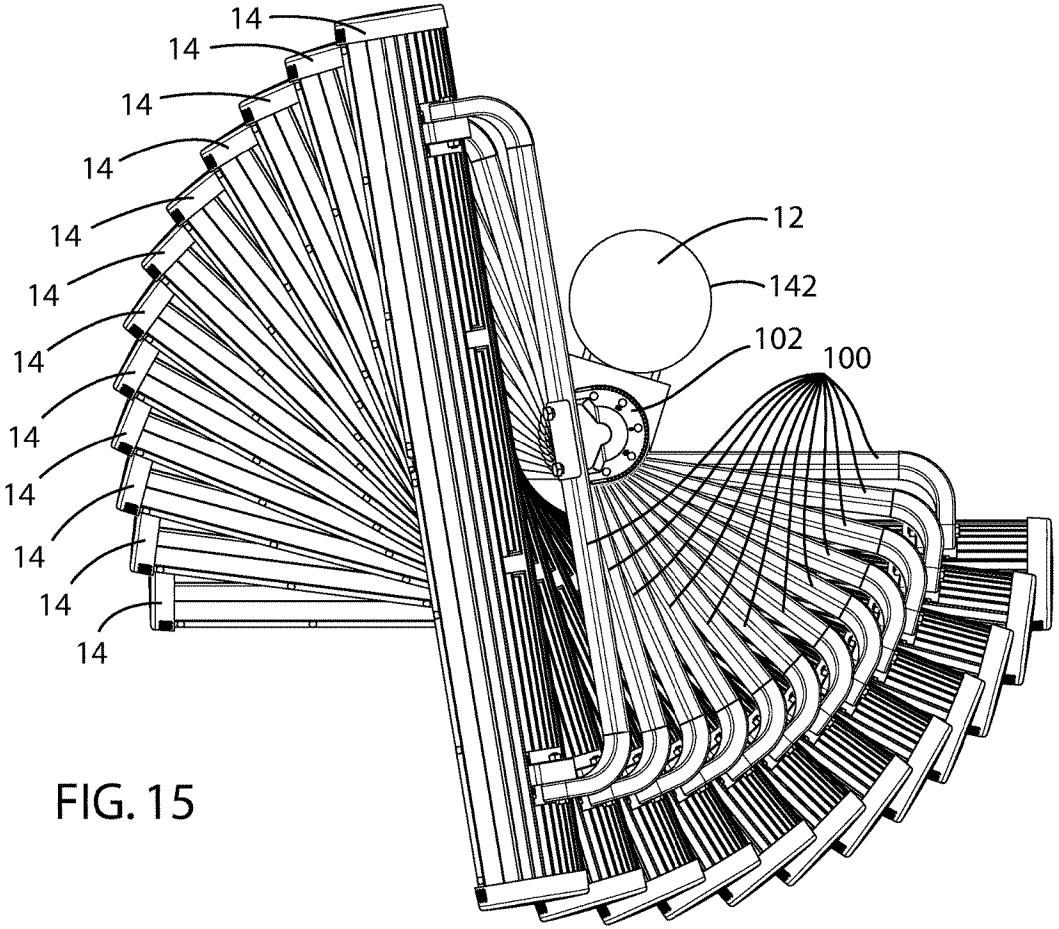
FIG. 15 is a top view of an elevated support supporting a plurality of the lighting assemblies of FIG. 1.
Figure 16:
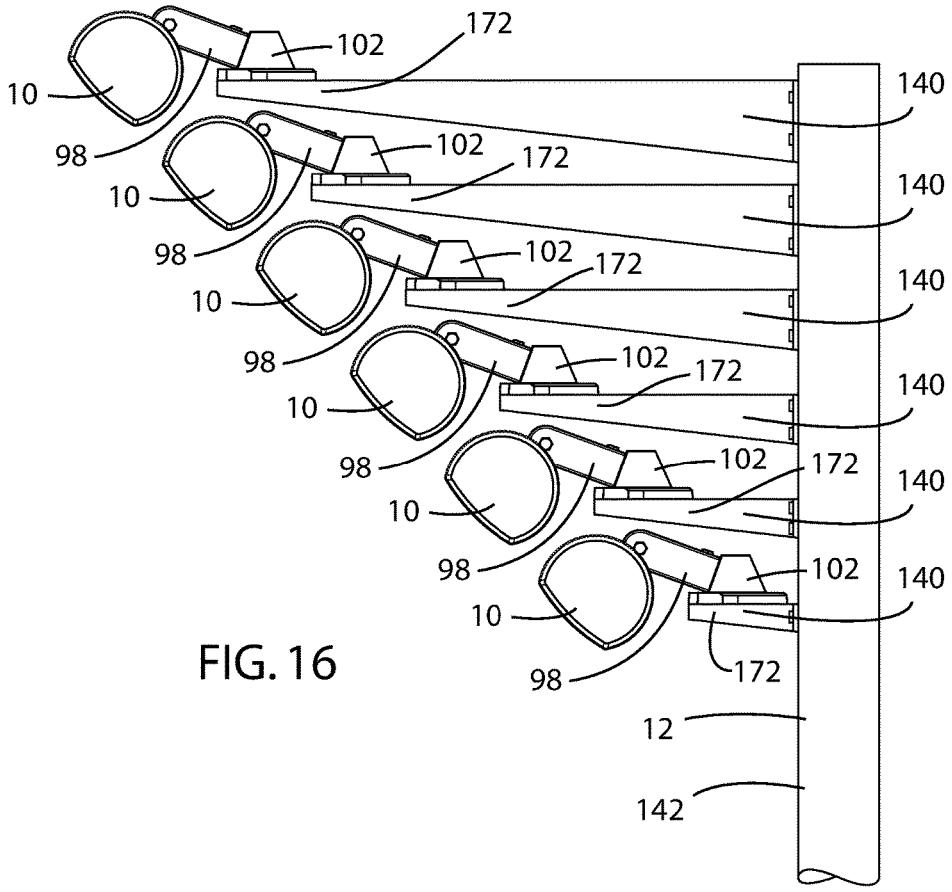
FIG. 16 is a side view of an elevated support supporting a plurality of the lighting assemblies of FIG. 1.
Figure 17:
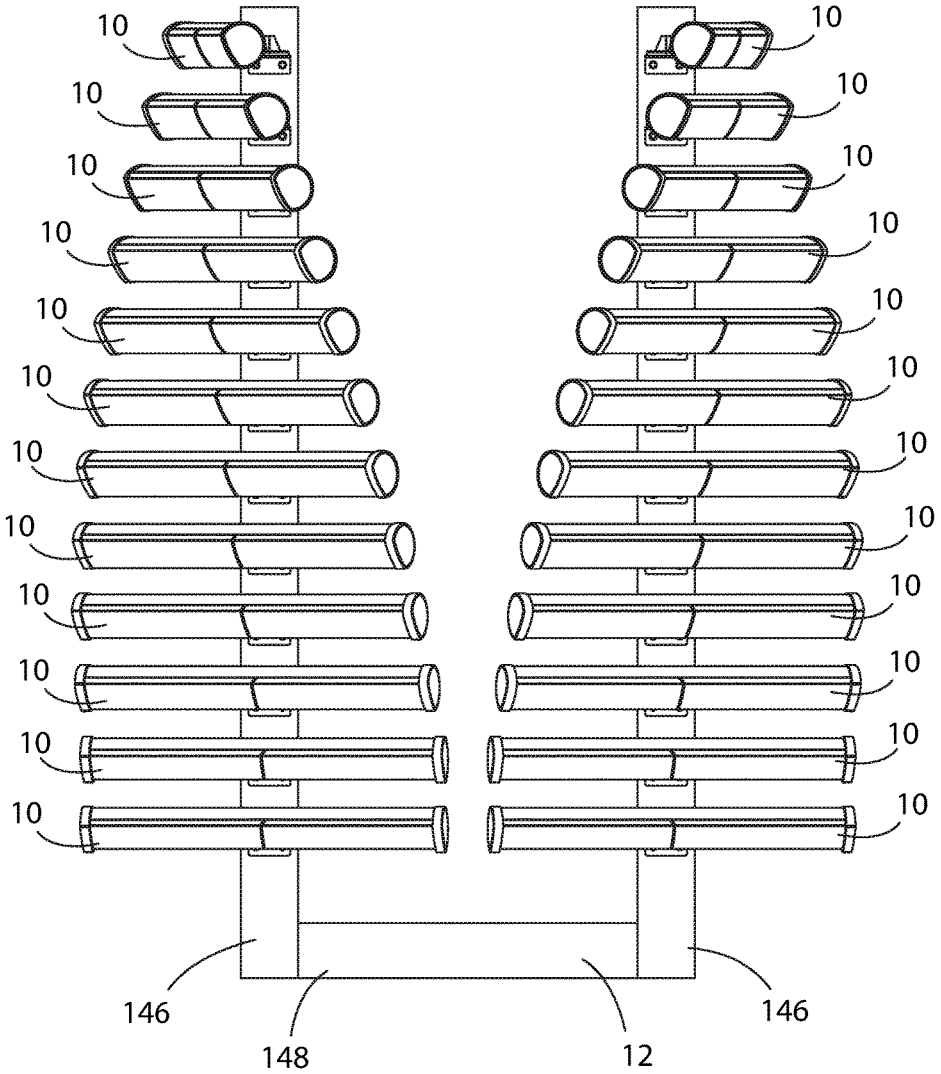
FIG. 17 is a front view of an elevated support structure supporting a plurality of the lighting assemblies of FIG. 1.

Preferably, a plurality of linearly extending luminaires 14 and brackets 28, which comprise the disclosed lighting assembly 10, are arranged vertically along the height of the elevated structure 12, with each of the plurality of linearly extending luminaires disposed one above the other along a vertical elevation of the elevated structure 12, as shown in FIGS. 14 through 17. More preferably, each of the plurality of mounting brackets 28 extends horizontally from the elevated structure 12 at a different horizontal distance via an extending arm 140, as shown in FIG. 16, such that the lowest of the plurality of mounting brackets 28 extends horizontally the least, the highest of the plurality of mounting brackets 28 extends horizontally the most, and the intermediate mounting brackets 28 each extend horizontally from the elevated structure a horizontal distance to create an inclined plane, as defined by the forward face of the plurality of linearly extending luminaires 14, from the highest to the lowest of the plurality of linearly extending luminaires 14. That is, each of the plurality of linearly extending luminaires 14 extends a different distance from the elevated structure 12, such that the highest linearly extending luminaire 14 extends the greatest horizontal distance from the elevated structure 12 and the lowest linearly extending luminaire 14 extends the shortest horizontal distance from the elevated structure 12. The mounting brackets are preferably affixed at a distal end 172 of the extending arms 140, as shown in FIG. 16.

Preferably, each of the plurality of linearly extending luminaires 12 is separately rotatable along a horizontal axis relative to the elevated structure 12. Likewise, each of the plurality of linearly extending luminaires 14 is separately rotatable along a vertical axis relative to the elevated structure 12. Thus, the focus of aim of each individual linearly extending luminaire 14 can be separately aimed in the horizontal axis and vertical axis to maximize the amount of light provided on the field or adjacent area below the elevated structure 12.

As noted above, the elevated structure 12 can take many forms. The simplest would be a simple pole 142, at the top of which one or more of the linearly extending luminaires 14 of the present disclosure can be mounted to the pole 142 via the bracket 28, as shown in FIGS. 14 through 16. Indeed, in accordance with the present disclosure, highly complicated light patterns may be developed and presented to the ground below the elevated structure 12 as may be needed by virtue of the that each of the linear extending luminaires 14 and their corresponding brackets 28 can rotate independently relative the elevated structure 12.

Alternatively, the elevated structure 12 can take the form of a scaffolding assembly 144, such as a pair of upwardly extending rails 146 joined by a base rail 148 that can be attached to a stadium seating structure. Such a structure is particularly useful for mounting the lighting assembly 10 of the present disclosure to the back structure of, for example stadium bleachers to provide illumination over the spectators of the event, as well as on the field of the event itself.

Figure 18:
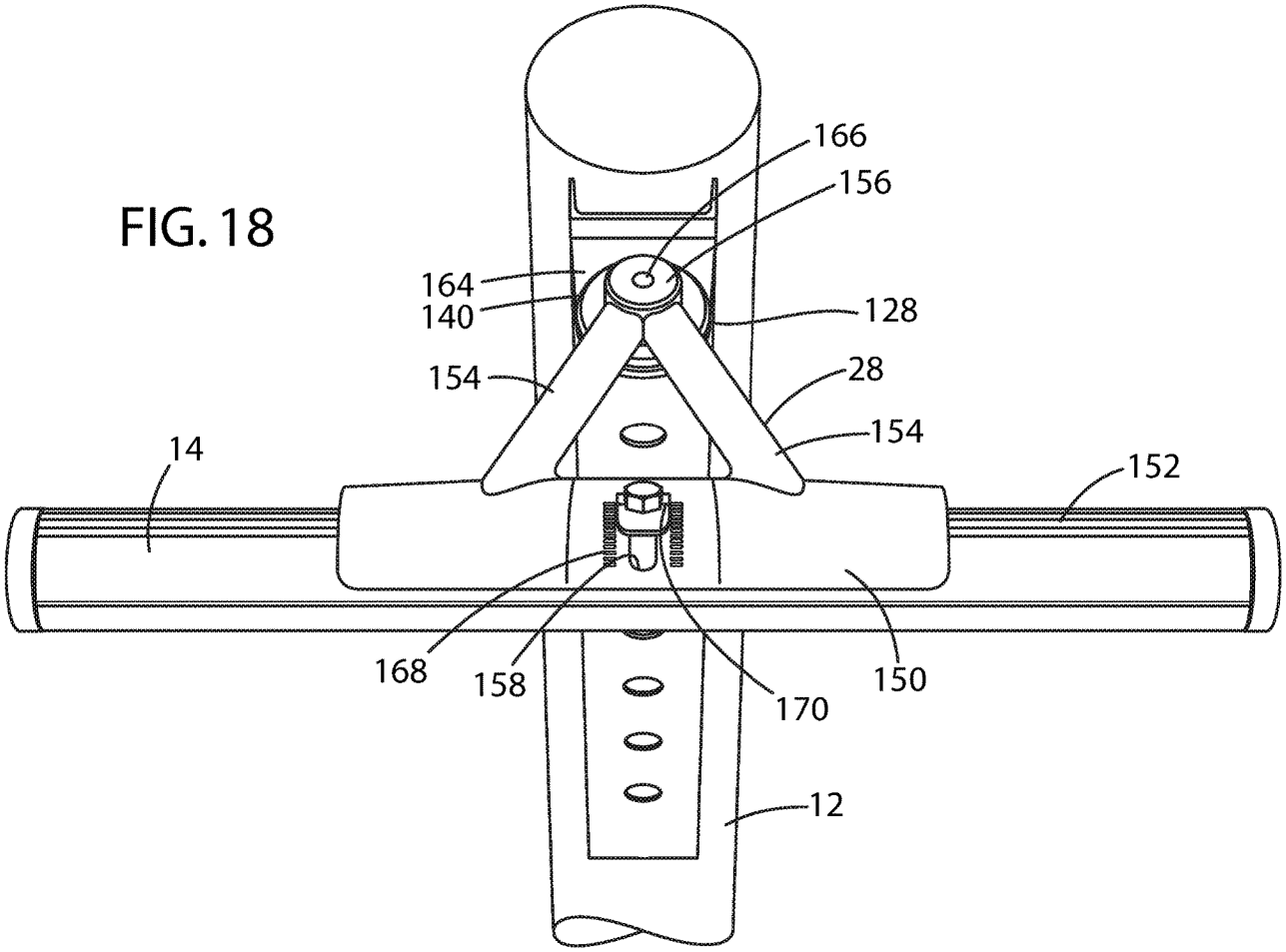
FIG. 18 is a front perspective view of a second embodiment of a lighting assembly of the present disclosure.
Figure 19:
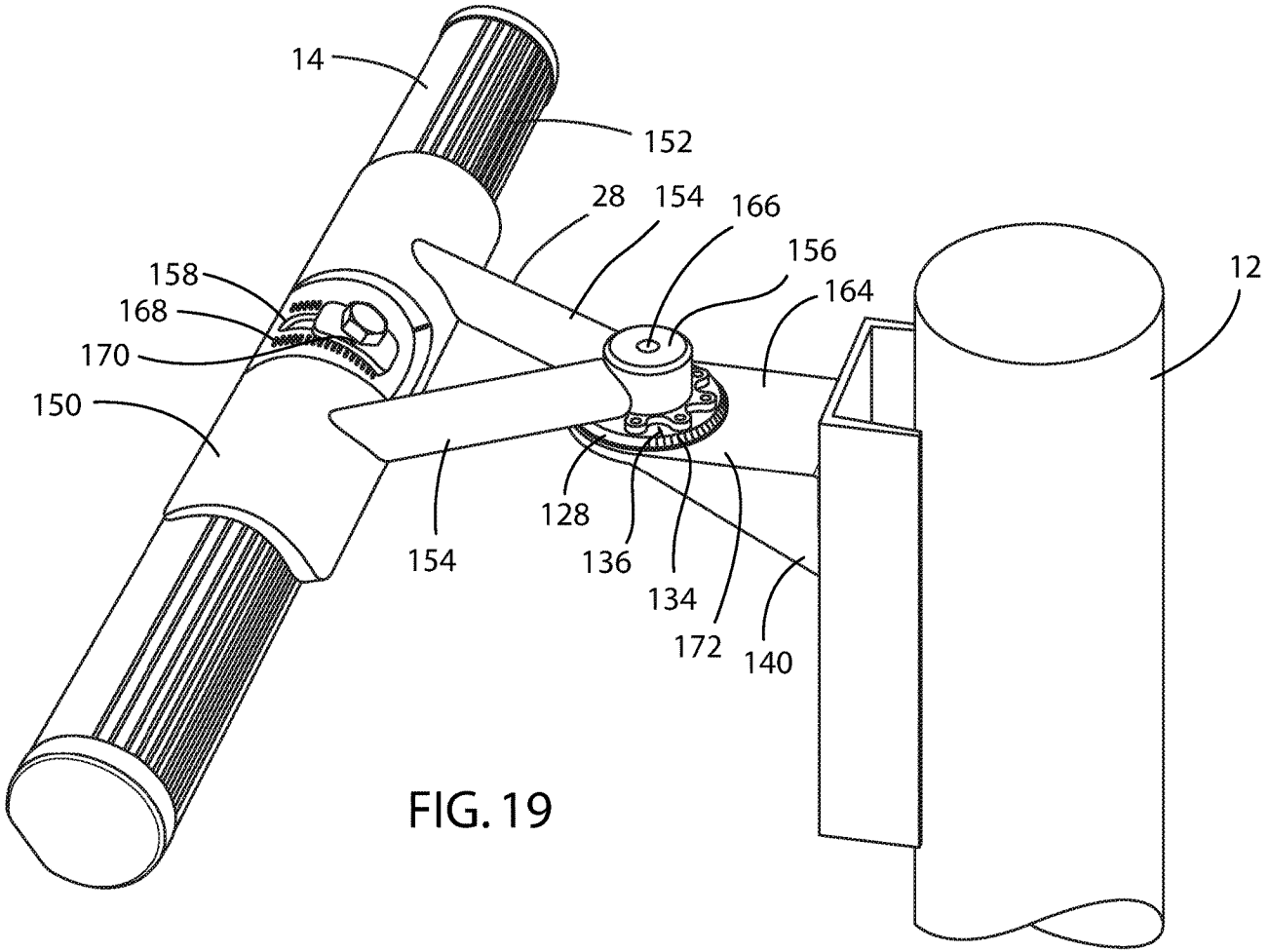
FIG. 19 is another front perspective view of the second embodiment of a lighting assembly of FIG. 17.

A second embodiment of the bracket 28 is shown in FIGS. 18 and 19. In this second embodiment, the bracket 28 includes a curved semicircular base 150 conforming to and within which is received the rear portion 152 of the linearly extending luminaire 14. A pair of intersecting arms 154 is each attached to the curved semicircular base 150 in to the mounting member 128 and a mounting pivot 156 mounted on a extending arm 140 of the elevated structure 12. A central slot 158 receives a locking fastener 160. A locking plate 162, which has a curved bearing surface conforming to the curvature of the semicircular base 150 and the rear portion 152 of the linearly extending luminaire 14, is engaged by the locking fastener 160. One end of the locking fastener 160 is received within a threaded opening in the rear portion 152 of the linearly extending luminaire 14. By tightening the locking fastener 160, the linearly extending luminaire 14 can be rotated along its horizontal axis within the central slot 158 provided in the curved semicircular base 150 of the bracket 28. When the linearly extending luminaires 14 is in its desired position, the locking fastener 160 can be tightened and the linearly extending luminaire 14 can then be locked in position.

The extending arm 140 on the elevated structure 12 in this embodiment preferably comprises a horizontal platform 164 through which a central opening (not shown) is provided. The central opening receives a lockable pivot pin 166 that is attached to the mounting pivot 156, which can likewise be indexed, as noted above. By unlocking the lockable pivot pin 166, the bracket 28 can be rotated in the vertical axis relative the elevated structure 12 to provide rotational side to side adjustment along the vertical axis. Similarly locking the lockable pivot pin 166 will fix the linearly extending luminaire 14 and the bracket 28 in a fixed position relative to the elevated structure 12. Preferably, as in the first embodiment, a plurality of angular indexes 134 is provided around a portion of the circumference of the mounting pivot 156 and an indicator 136 is mounted on the mounting pivot 156. Similarly, a plurality of angular indexes 168 is provided on the semicircular base 150 proximate the central slot 158 and an indicator 170 is mounted on the locking plate 162 by which the relative angle of the linearly extending luminaire 14 to the bracket 28 can be preset.

As in the case of the first embodiment, each of the plurality of linearly extending luminaires 14 is separately rotatable along a horizontal axis relative to the elevated structure 12. Likewise, each of the plurality of linearly extending luminaires 14 is separately rotatable along a vertical axis relative to the elevated structure 12. Thus, the focus of aim of each individual linearly extending luminaire 14 can be separately aimed in the horizontal axis and vertical access to maximize the amount of light provided on the field or adjacent area below the elevated structure 12.

The lighting assembly 10 of the present disclosure provides high-efficiency LED lighting, which results in relatively low power consumption and very low lumen depreciation. The use of high-efficiency LEDs lighting also provides nearly instant on/off functionality, which in turn allows for emergency activation and requires no warm-up or cooldown time. The lighting assembly 10 also provides desired color consistency, high correlated color temperature and color rendering index, and is infinitely dimmable. The lighting assembly 10 of the present disclosure also provides a system that can be pre-aimed, improving the ease of installation and providing more certain light levels utilizing system engineer components.

It will be understood by one having ordinary skill in the art that construction of the described present disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

For purposes of this disclosure, the term "operably connected" generally means that one component functions with respect to another component, even if there are other components located between the first and second component, and the term "operable" defines a functional relationship between components.

It is also important to note that the construction and arrangement of the elements of the present disclosure as shown in the exemplary embodiments is illustrative only. Although only a few embodiments of the present innovations have been described in detail in this disclosure, those skilled in the art who review this disclosure will readily appreciate that, unless otherwise described, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating positions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. A lighting system for providing an enlarged area of illumination over an area of land, the lighting system comprising:

an elevated structure;

a plurality of elongated and linearly extending luminaires, each of the elongated and linearly extending luminaires having an electronic circuit board having a first forward facing surface and a second rearward facing surface, an inner lens assembly attached to the forward facing surface of the electronic circuit board, the inner lens assembly including an array of focused light sources, an outer lens disposed over the inner lens assembly, and a heatsink attached to the second rearward facing surface of the electronic circuit board, the heatsink having a rear surface and extending along the length of the elongated and linearly extending luminaire; and a plurality of brackets pivotally attached to each of the plurality of elongated and linearly extending luminaires, each of the brackets having an axis of rotation around a horizontal axis, whereby each of the plurality of elongated and linearly extending luminaires is separately rotatable along the horizontal axis relative to the elevated structure, and each of the brackets having an axis of rotation around a vertical axis orthogonal to the horizontal axis, whereby each of the plurality of elongated and linearly extending luminaires is separately rotatable along the vertical axis relative to the elevated structure;

wherein the elevated structure comprises the plurality of brackets vertically arranged along a height of the elevated structure and each of the plurality of elongated an linearly extending luminaires is disposed one above the other along a vertical elevation of the elevated structure; and wherein the plurality of brackets each extends horizontally from the elevated structure at a different horizontal distance, such that the lowest of the plurality of brackets extends horizontally the least, the highest of the plurality of brackets extends horizontally the most, and the intermediate brackets each extend horizontally from the elevated structure a horizontal distance to create an inclined plane from the highest to the lowest of the plurality of brackets.

2. The lighting system of claim 1, wherein the bracket is pivotally attached to the rear surface of the heatsink, and the bracket comprises a pair of opposed mounting arms, a central member extending between the opposed mounting arms, and a base coupled to the central member.

3. The lighting assembly of claim 2, wherein the rear surface of the heatsink includes a pair of mounting ears coupled to the heatsink, wherein each of the pair of opposed mounting arms of the bracket is attached to one of the pair of mounting ears.

4. The lighting assembly of claim 3, wherein each of the pair of opposed mounting arms is pivotally attached to one of the pair of mounting ears.

5. The lighting assembly of claim 3, wherein each of the pair of opposed mounting arms is curved forwardly and downwardly toward the one of the pair of mounting ears.

6. The lighting assembly of claim 2, wherein the base includes an attachment clamp rigidly engaged with the central member and a mounting member adapted to support the lighting assembly, wherein the attachment clamp is rotatably coupled with the mounting member.

7. The lighting system of claim 1, wherein the bracket is pivotally attached to the rear surface of the heatsink, and the bracket comprises a base conforming to and within which is received a rear portion of the elongated and linearly extending luminaire, a pair of intersecting arms each attached to the base and each attached to a pivot mounted on a support of the elevated structure.

8. The lighting assembly of claim 1, wherein the array of focused light sources includes a plurality of LED lamps each disposed within a focused lens housing disposed across substantially an entire forward face of the inner lens.

9. The lighting assembly of claim 1, wherein the outer lens is sealingly coupled with the heatsink and the inner lens assembly is sealingly disposed between the outer lens and the heatsink.

10. The lighting assembly of claim 1, wherein the lighting assembly includes a pair of opposed end caps, wherein each of the end caps engages the outer lens and the heatsink at opposed ends of the elongated and linearly extending luminaire.

11. The lighting assembly of claim 1, wherein the rear surface of the heatsink includes a pair of mounting ears coupled to the heatsink, each of the pair of opposed mounting arms of the elongated and linearly extending bracket is attached to one of the pair of mounting ears, each of the pair of opposed mounting arms being pivotally attached to one of the pair of mounting ears, and the base comprises an attachment clamp rigidly engaged with the elongated and linearly extending central member and a mounting member adapted to support the lighting assembly, wherein the attachment clamp is coupled with the mounting member, and the elongated and linearly extending luminaire is adapted to rotate in multiple axis relative the mounting member.

12. A lighting system for providing an enlarged area of illumination over an area of land, the lighting system comprising:

an elevated structure;

a plurality of elongated and linearly extending luminaries, each of the elongated and linearly extending luminaries having an electronic circuit board having a first forward facing surface and a second rearward facing surface, an inner lens assembly attached to the forward facing surface of the electronic circuit board, the inner lens assembly including an array of focused light sources, an outer lens disposed over the inner lens assembly, and a heatsink attached to the second rearward facing surface of the electronic circuit board, the heatsink having a rear surface and extending along the length of the elongated and linearly extending luminaire; and a plurality of extending brackets pivotally attached to each of the plurality of elongated and linearly extending luminaries, each of the brackets having an axis of rotation around a horizontal axis, whereby each of the plurality of elongated and linearly extending luminaries is separately rotatable along the horizontal axis relative to the elevated structure, and each of the brackets having an axis of rotation around a vertical axis orthogonal to the horizontal axis, whereby each of the plurality of elongated and linearly extending luminaries is separately rotatable along the vertical axis relative to the elevated structure;

wherein the bracket is pivotally attached to the rear surface of the heatsink, and the bracket comprises a base conforming to and within which is received a rear portion of the elongated and linearly extending luminaire, a pair of intersecting arms attached to each of the base and a pivot mounted on a support of the elevated structure; and wherein the base has a central slot receiving a locking faster and the elongated and linearly extending luminaire has a threaded opening in a rear portion thereof receiving the locking fastener, whereby the elongated and linearly extending luminaire can be rotated along the horizontal axis within the central slot provided in the base of the bracket.

13. The lighting system of claim 12, wherein the elevated structure comprises a plurality of brackets vertically arranged along a height of the elevated structure and each of the plurality of elongated and linearly extending luminaires is disposed one above the other along a vertical elevation of the elevated structure.

14. The lighting system of claim 12, wherein each of the plurality of elongated and linearly extending luminaires extends a different distance from the elevated structure, such that the highest elongated and linearly extending luminaire extends the greatest horizontal distance from the elevated structure and the lowest elongated and linearly extending luminaire extends the shortest horizontal distance from the elevated structure.

15. The lighting system of claim 12, wherein the elevated structure is a pole.

16. The lighting system claim 12, wherein the elevated structure is a scaffolding system.

17. The lighting assembly of claim 12, wherein each of the plurality of elongated and linearly extending luminaires is mounted a different horizontal distance from the elevated structure.

* * * * *